US007314161B1

(12) United States Patent
Korte et al.

(10) Patent No.: US 7,314,161 B1
(45) Date of Patent: Jan. 1, 2008

(54) APPARATUS AND METHOD FOR IMPROVED PRIVACY IN USING AUTOMATED BANKING MACHINE

(75) Inventors: Steven Korte, Canton, OH (US); Donald S. Nelson, Jr., Akron, OH (US); Michael J. Maczuzak, Bratenahl, OH (US); Jesse P. Carlson, Bay Village, OH (US)

(73) Assignee: Diebold SCLF - Service Systems division of Diebold, Incorporated, North Canton, OH (US)

( * ) Notice: Subject to any disclaimer, the term of this patent is extended or adjusted under 35 U.S.C. 154(b) by 838 days.

(21) Appl. No.: 10/688,530

(22) Filed: Oct. 17, 2003

(51) Int. Cl.
*G07F 19/00* (2006.01)

(52) U.S. Cl. ..... 235/379

(58) Field of Classification Search ..... 235/379; 902/8, 9, 14, 30

See application file for complete search history.

(56) References Cited

U.S. PATENT DOCUMENTS 4,399,755 A * 8/1983 Wiedmann ..... 109/2
4,911,087 A * 3/1990 Couvrette ..... 109/24.1
5,222,445 A * 6/1993 Capraro ..... 109/2
6,000,806 A * 12/1999 Dallman ..... 362/85

* cited by examiner

*Primary Examiner*—Thien M. Le
*Assistant Examiner*—April Taylor
(74) *Attorney, Agent, or Firm*—Ralph E. Jocke; Daniel D. Wasil; Walker & Jocke

(57) ABSTRACT

A privacy apparatus (42) is installed on an existing ATM (12) to provide improved privacy for users of the machine. A frame (44) includes members (48, 56, 64) and extends externally of the ATM housing (14). A pair of disposed vertically extending panels (46) are attached in supporting connection with the frame. Each panel includes a generally horizontally extending shelf (76) which provides a support and writing surface. The privacy apparatus may be readily installed and removed without a requirement for producing fastener openings or other modifications to the existing ATM housing.

28 Claims, 7 Drawing Sheets

APPARATUS AND METHOD FOR IMPROVED PRIVACY IN USING AUTOMATED BANKING MACHINE

TECHNICAL FIELD

This invention relates to automated banking machines. Specifically, this invention relates to an apparatus and method for providing improved privacy for users who operate automated banking machines.

BACKGROUND ART

Automated banking machines are known in prior art. Certain types of automated banking machines used by consumers to conduct transactions are known as automated teller machines ("ATMs"). ATMs may be used by consumers to conduct financial transactions. Such transactions may include the receipt of cash, the deposit of funds, the cashing of checks, the receipt of stamps, the receipt of scrip, the printing of tickets, and other transactions. Other types of automated banking machines may be used by customer service representatives, consumers or both. Examples of such automated banking machines include transportation ticketing terminals, rental car terminals and terminals used for purchasing goods or services. For purposes of this disclosure an automated banking machine will be considered to include any type of machine that is operative to conduct transactions involving transfers of value.

Automated banking machines generally operate in a network in conjunction with at least one remote computer so as to electronically carry out the transactions requested by the user. An example of such a system is shown in U.S. Pat. No. 6,334,117, the disclosure of which is incorporated herein by reference.

Automated banking machines generally include a user interface. The user interface enables a user to interact with the machine for purposes of carrying out transaction activities. In an ATM the user interface usually includes input and output devices. The output devices may include, for example, a display or audio output device. Input devices of a user interface may include, for example, function keys, a keypad, a touchscreen display, a card reader, a biometric reader and/or a microphone for receiving audible commands. It should be understood that these input and output devices are exemplary and in other embodiments other input and output devices may be used.

Operators of automated banking machines often must provide inputs to the machines. In providing some inputs such as customer PINs or other private inputs, customers may desire that persons nearby not be able to intercept such inputs. In addition, when banking machine users are conducting transactions, they generally do not want others to view or otherwise sense information about the transactions they are conducting.

Further, in the conduct of transactions, customers sometimes find it helpful to have a place to support items such as wallets, purses, debit or credit cards, paperwork or other items that the customer may want to set down in order to free their hands to operate the machine. In addition users of banking machines sometimes find it helpful to have available writing surfaces or other horizontal surfaces adjacent to the machine.

Free-standing automated banking machines which are designed to be operated in a lobby, retail store, or other open area within a building sometimes present opportunities for nearby persons to observe activities at the customer interface. Thus there exists a need for an apparatus and method for providing enhanced privacy in the use of such machines.

DISCLOSURE OF INVENTION

It is an object of an exemplary embodiment of the present invention to provide an apparatus that provides enhanced privacy for users of automated banking machines.

It is a further object of an exemplary embodiment of the present invention to provide an apparatus that improves privacy for users of automated banking machines and that may be readily installed on existing banking machines.

It is a further object of an exemplary embodiment of the present invention to provide an apparatus for improving privacy for users of an automated banking machine that may be readily installed on a variety of different machines.

It is a further object of an exemplary embodiment of the present invention to provide an apparatus for improving privacy in operation of an automated banking machine that includes horizontal support surfaces for holding items and/or to provide a writing surface.

It is a further object of an exemplary embodiment of the present invention to provide a method for providing improved privacy for a user of an automated banking machine.

It is a further object of an exemplary embodiment of the present invention to provide a method of installing an apparatus for improving privacy on an automated banking machine.

It is a further object of an exemplary embodiment of the present invention to provide a method for installing an apparatus that improves privacy for a user of an automated banking machine that may be installed and/or removed without modifying the exterior housing of the automated banking machine.

Further objects of exemplary forms of the present invention will be made apparent in the following Best Modes for Carrying Out Invention and the appended claims.

The foregoing objects are accomplished in an exemplary embodiment by an apparatus including a frame. The apparatus is adapted for use with an existing automated banking machine having a housing exterior. The frame includes two generally vertically extending frame members that extend on opposed sides of the housing. The ATM housing further includes a top housing surface and a lower housing surface. A top brace member extends above the top housing surface and operatively engages both of the vertically extending frame members. The bottom brace member extends below the bottom housing surface and operatively engages both of the vertically extending frame members.

In an exemplary embodiment the vertically extending frame members include a first leg portion and a second leg portion. The second leg portion extends generally away from the housing and transverse to a user interface surface of the machine which supports one or more of the input devices. A privacy panel is engaged in supporting connection with each of the frame members. In the exemplary embodiment the panels extend from the machine so that a person positioned to operate the machine is generally positioned intermediate of the panels. In an exemplary embodiment the panels extend so as to generally prevent the observation of inputs by the machine user to input devices on the user interface, by third parties or observation devices positioned behind or to the side of the user. In an exemplary embodiment the panels further include generally horizontally extending shelf surfaces. Such shelf surfaces provide convenient places for supporting items as well as a writing surface.

In an exemplary embodiment the apparatus is attached to the machine without having to modify the existing machine housing. This eliminates the need for drilling holes or conducting similar activities that may result in damage to internal components of the machine or to the machine's structural integrity. Further in an exemplary embodiment the apparatus may be removed and the machine returned to its original condition. This may be desirable, for example, if the machine is to be transported or the machine is to be replaced with a different machine to which the apparatus is to be installed.

An exemplary form of the present invention further includes a method for installing such an apparatus for enhancing privacy for users at an automated banking machine as well as such a machine with an apparatus installed thereon.

BEST MODE FOR CARRYING OUT INVENTION

Figure 1:
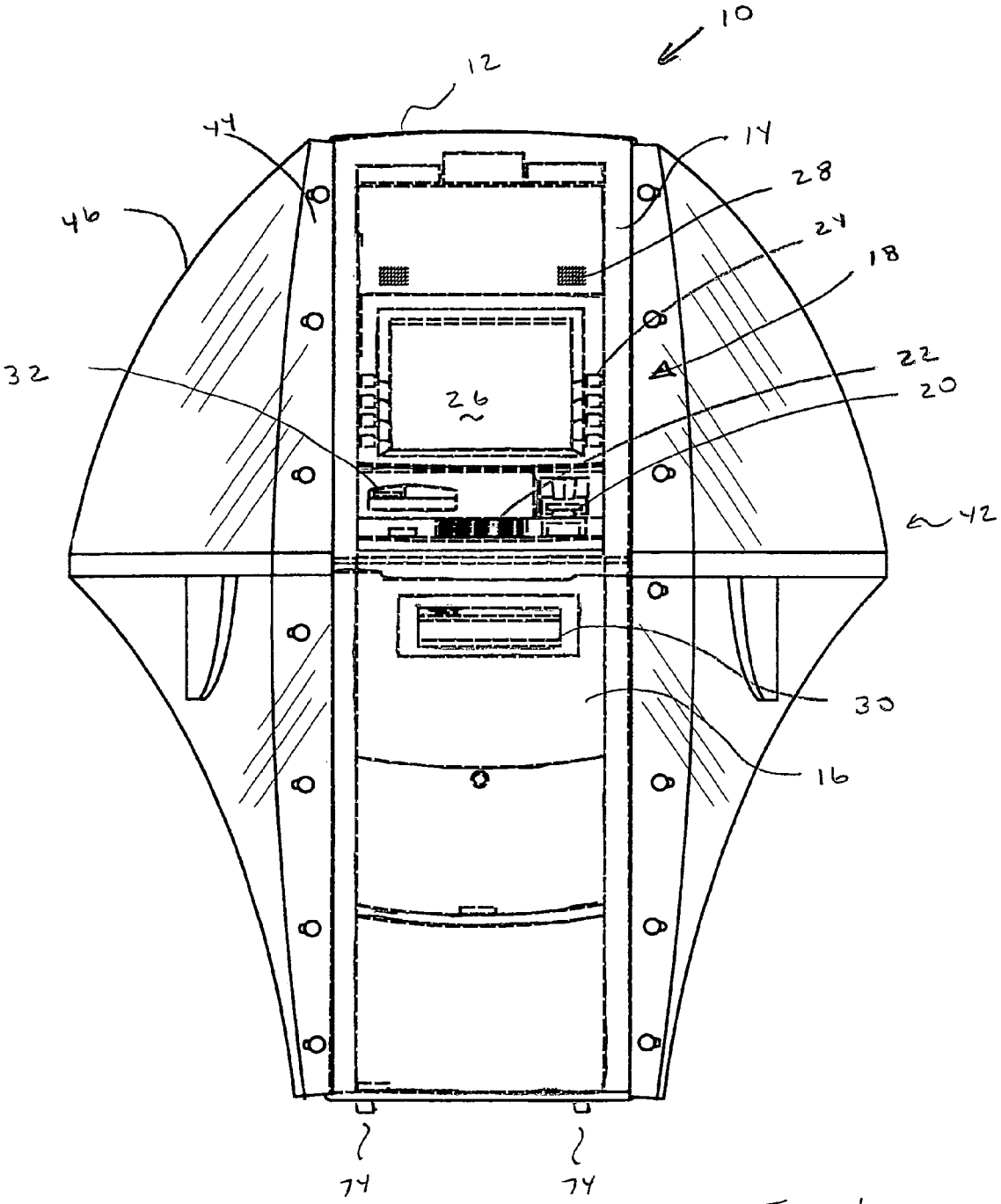
FIG. 1 is a front view of an automated banking machine shown in conjunction with an apparatus for improving privacy of an exemplary form of the present invention.

Referring now to the drawings and particularly to FIG. 1, there is shown therein an exemplary embodiment of an apparatus generally indicated 10. The apparatus is shown in conjunction with an automated banking machine 12. In an exemplary embodiment the automated banking machine 12 comprises an ATM which is adapted for use by consumers in carrying out banking transactions. Of course in other embodiments other types of automated banking machines may be used.

Figure 2:
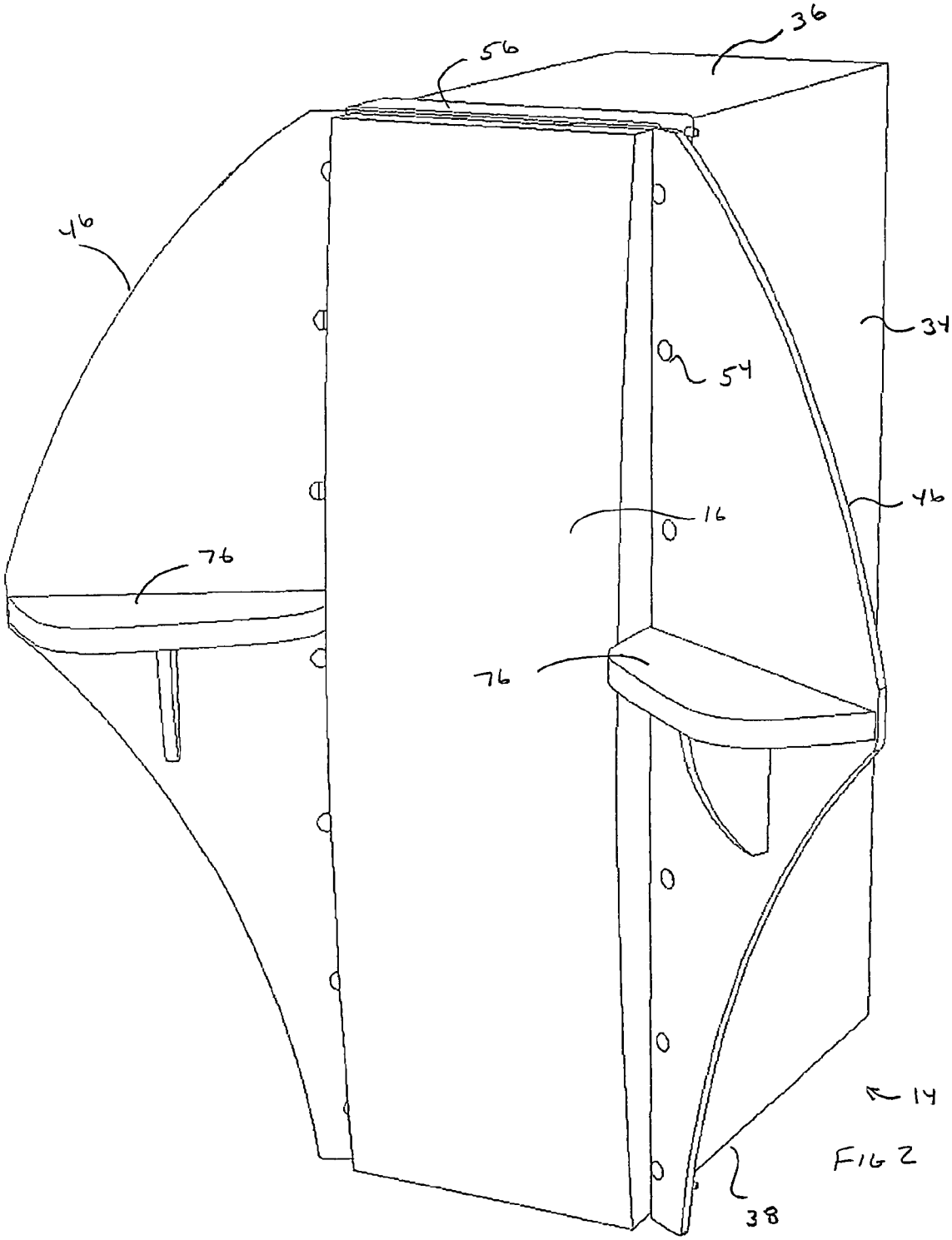
FIG. 2 is a perspective view showing the automated banking machine and apparatus of FIG. 1.
Figure 3:
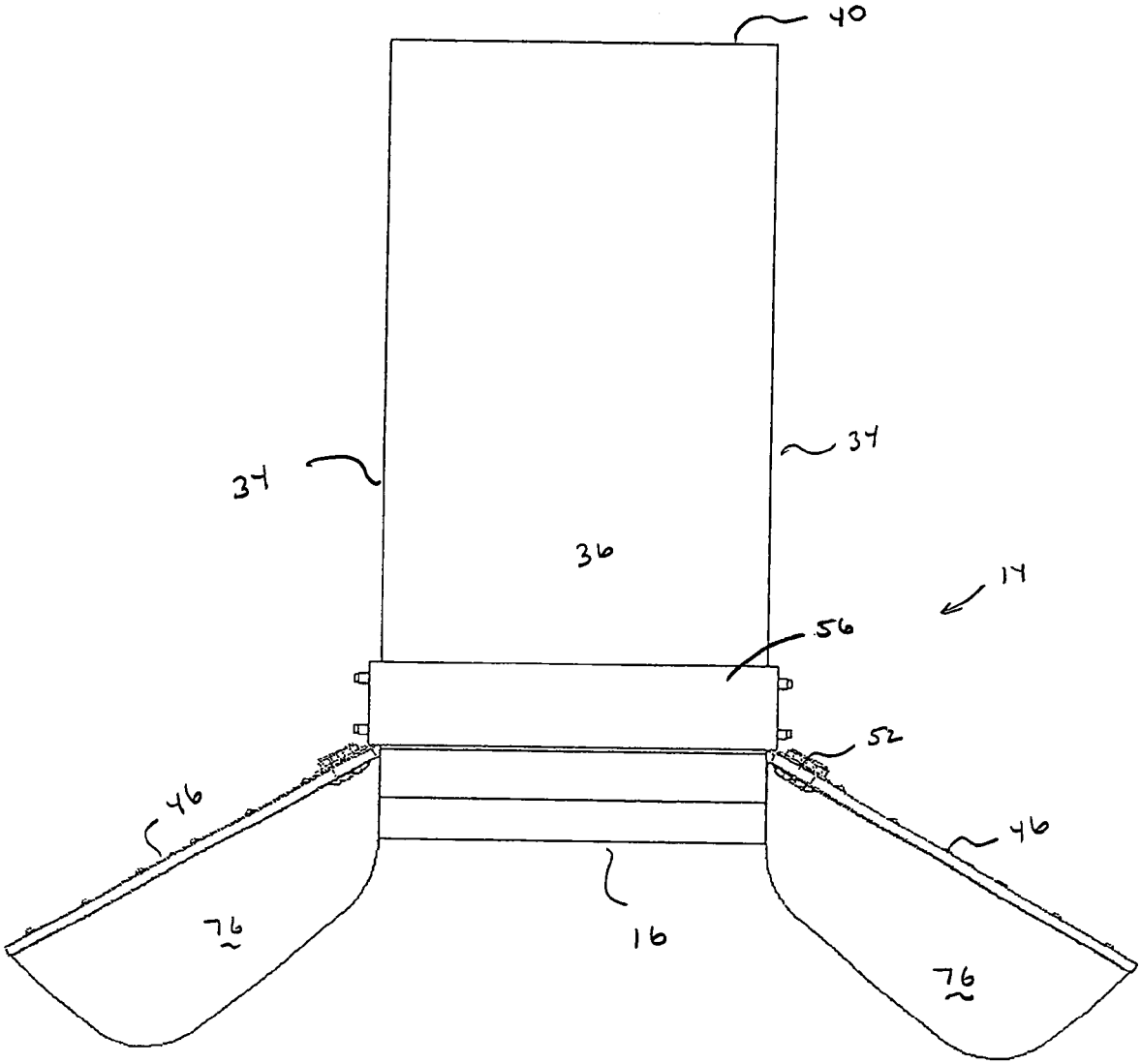
FIG. 3 is a top view of the automated banking machine and apparatus shown in FIG. 1.
Figure 4:
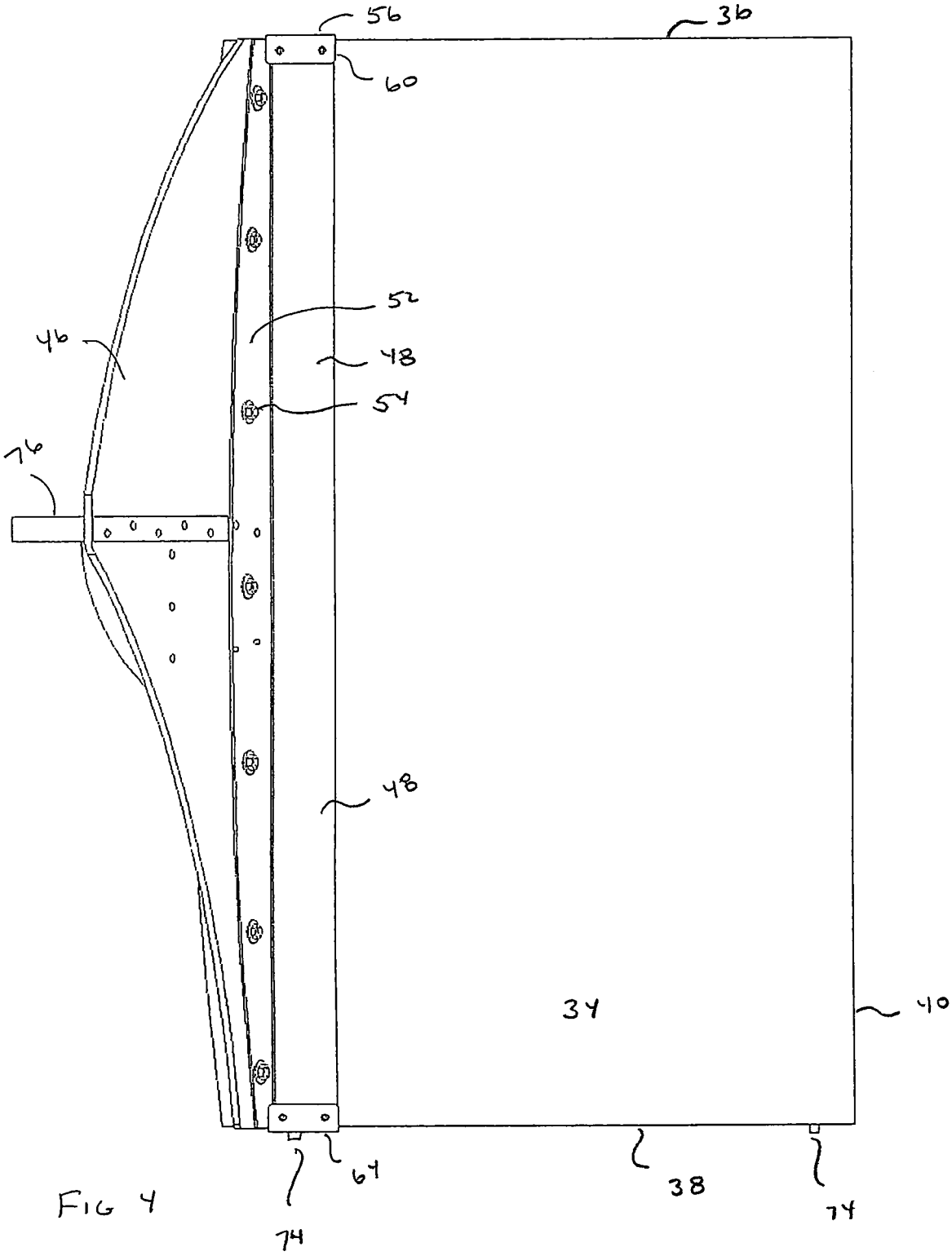
FIG. 4 is a right side view of the automated banking machine and apparatus shown in FIG. 1.
Figure 5:
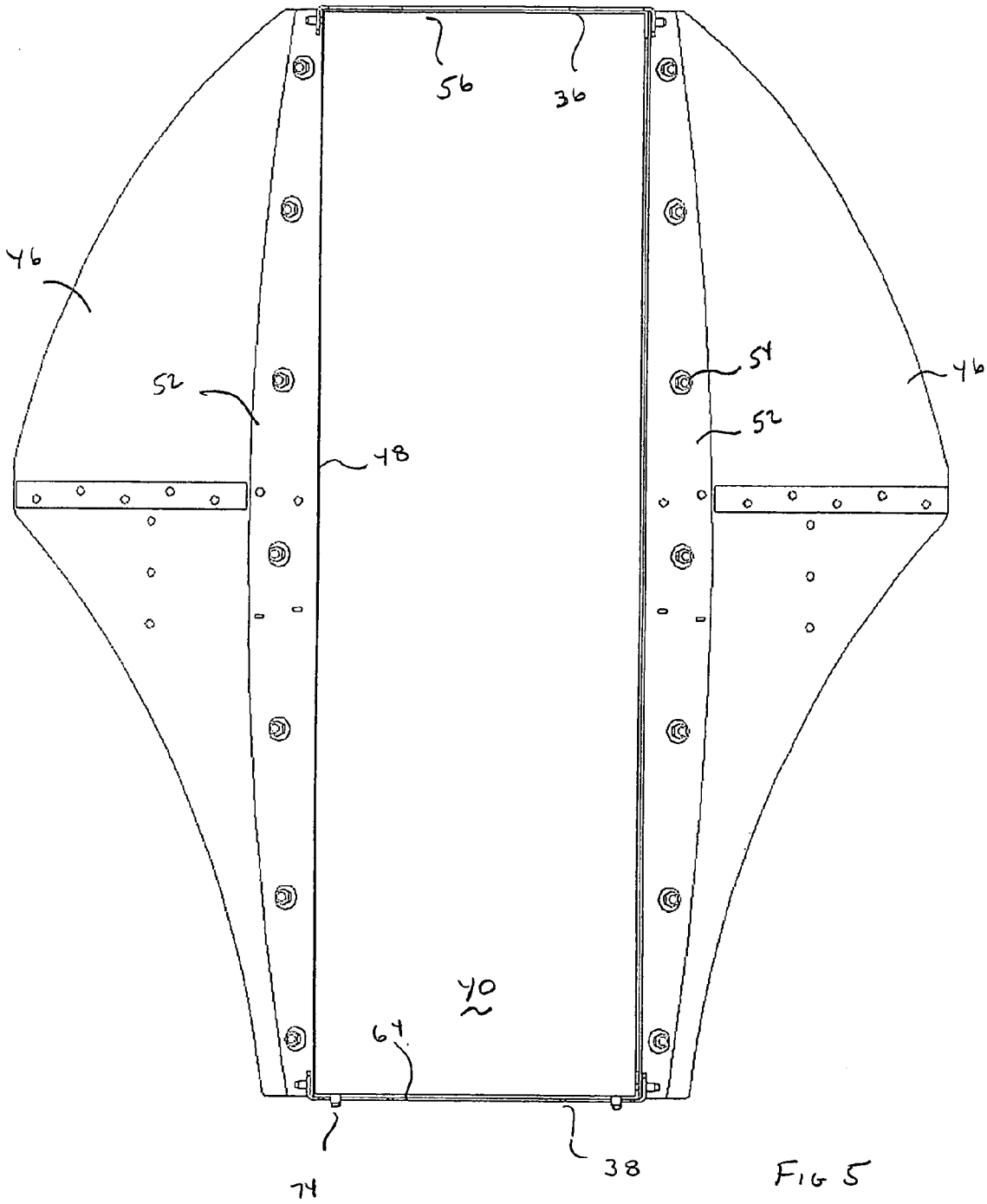
FIG. 5 is a rear view of the automated banking machine and apparatus shown in FIG. 1.
Figure 6:
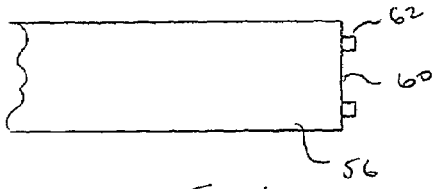
FIG. 6 is a top view of a top brace member of a frame of the apparatus.
Figure 10:
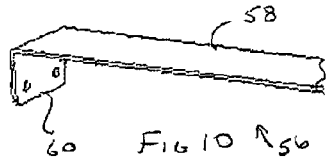
FIG. 10 is an isometric view of the top brace member shown in FIG. 6.
Figure 7:
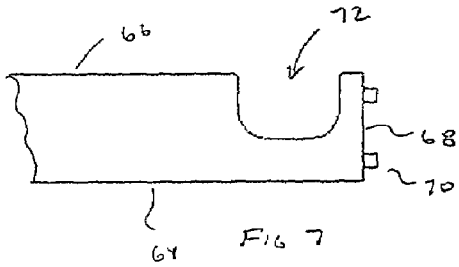
FIG. 7 is a bottom plan view of a bottom brace member of the frame.
Figure 11:
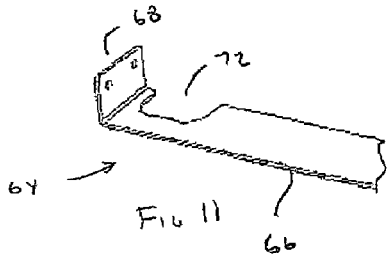
FIG. 11 is an isometric view of the bottom brace member shown in FIG. 7.
Figure 8:
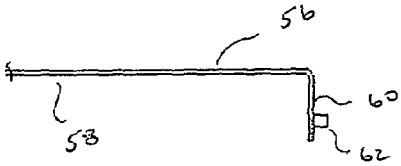
FIG. 8 is a side view of the top brace member shown in FIG. 6.
Figure 12:
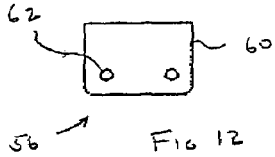
FIG. 12 is a front view of an ear portion of the top brace member.
Figure 9:
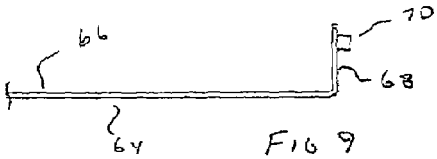
FIG. 9 is a side view of the bottom brace member shown in FIG. 7.
Figure 13:
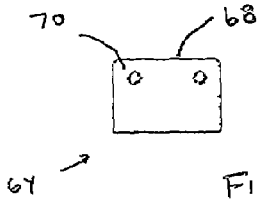
FIG. 13 is a front view of an ear portion of the bottom brace member shown in FIG. 7.

ATM 12 includes an exterior housing 14. As shown in FIGS. 2 through 4, housing 14 comprises a generally rectangular housing which houses the internal components of the machine. Housing 14 includes a front surface 16 which includes thereon a user interface generally indicated 18. Exemplary user interface 18 includes input devices such as a card reader 20, keypad 22 and function keys 24. User interface 18 also includes output devices which include a display 26 and speakers 28. It should be understood that these input and output devices are exemplary and in other embodiments other or additional input and output devices may be used.

In the exemplary embodiment the automated banking machine includes a cash dispenser 30, the outlet of which is shown on the front surface 16. The exemplary machine further includes a printer 32, the outlet for which is shown and which in the exemplary embodiment is used to provide users of the machine with receipts for transactions conducted. Of course these devices are exemplary and in other embodiments additional or different devices may be included. The operation of various ATM devices is described in more detail in U.S. Pat. No. 6,318,714, a disclosure of which is incorporated herein by reference.

As shown in FIGS. 2 through 4, ATM housing 14 further includes a pair of vertically extending sides 34. The housing further includes a top housing surface 36 and a bottom housing surface 38. Housing 14 further includes a back surface 40. As can be appreciated, the surfaces of the housing which make up the machine include access doors or other suitable mechanisms which are not shown, for accessing the interior of the ATM.

Figure 14:
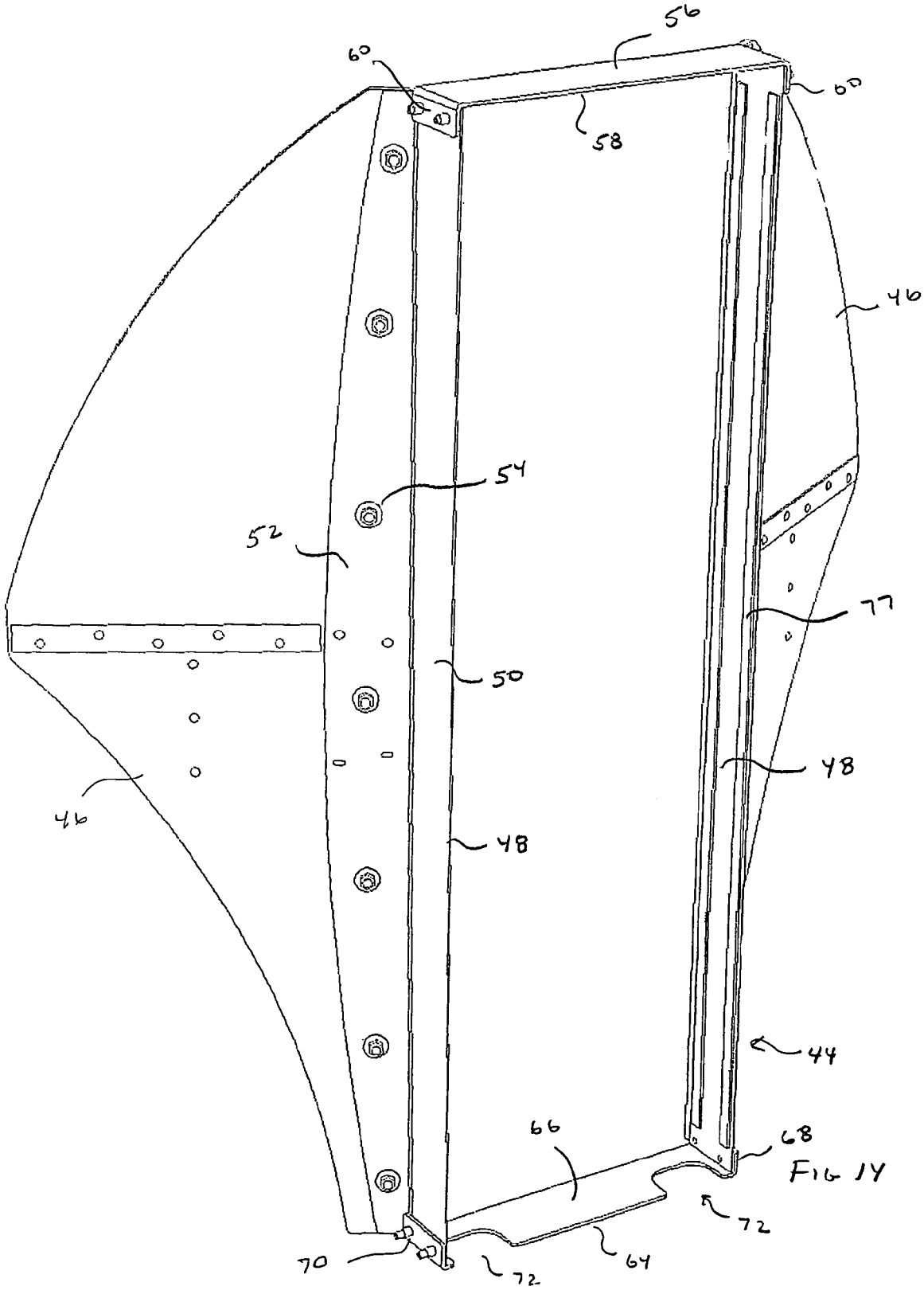
FIG. 14 is an isometric view of the frame with attached panels without the ATM being shown.

In an exemplary embodiment, privacy for users operating the ATM is enhanced through installation on the ATM housing of a privacy apparatus generally indicated 42. Privacy apparatus 42 includes a frame 44 as best shown in FIG. 14. In an exemplary embodiment frame 44 has attached thereto a pair of panels 46.

In the exemplary embodiment frame 44 is comprised of a pair of disposed vertically extending frame members 48. Frame members 48 are generally of an angled channel construction. Each frame member is generally comprised of a first leg portion 50 and a second leg portion 52. In the exemplary embodiment the first leg portion 50 is configured when installed to abut in a flush relation with side 34 of housing 14. Second leg portion 52, as shown in FIG. 14 and FIG. 3, extends in cross section at an obtuse angle relative to the first leg portion. When positioned on the ATM housing second leg portion 52 extends away from the housing and in a direction transverse to the user interface surface, which in the exemplary embodiment is the front surface of the machine. In the exemplary embodiment the second leg portion 52 further includes suitable openings or other means for accepting fasteners 54 or other devices for operatively connecting the panels 46 thereto.

Frame 44 further includes a top brace member 56. Top brace member 56 extends above the top housing surface 36 of the machine housing 14 when the frame is positioned on the ATM. Top frame member 58 includes a central portion 58 and a pair of opposed ear portions 60. As shown in FIG. 14 as well as in FIGS. 6, 8, 10, and 12, ear portions 60 extend generally perpendicular to central portion 58 and in a downward direction when frame 48 is assembled. Further, as shown in FIG. 14, in the assembled condition of the frame the upper portion of the frame members 48 extend inboard of the ear portions 60 and intermediate of the sides 34 of the housing and the ear portions 60. In the exemplary embodiment ear portions include sleeves 62 on an outboard portion thereof. Sleeves 62 are adapted for receiving fastening members (not separately shown) that serve to operatively engage the top brace member with both of the vertically extending frame members. Various types of fasteners may be used, including suitable bolts, studs or other members.

A bottom brace member 64 operatively connects the frame members 48 at a lower portion thereof. In the operative position of the frame 44 on the machine housing, bottom brace member 64 extends below bottom housing surface 38. Bottom brace member 64 includes a central portion 66 and a pair of opposed ear portions 68. As shown in FIG. 14, ear portions 68 extend generally perpendicular to the central portion 66 and extend in an upward direction when the bottom brace member is assembled in the frame 44. Ear portions 68 include sleeves 70 for accepting fastening members and hold the frame members 48 and the bottom brace member 64 in operatively engaged relation.

Bottom brace member 64 further includes a pair of disposed cutouts 72. As shown in FIG. 1, housing 14 of the ATM includes support legs 74 which extend below the bottom housing surface. A pair of support legs 74 are positioned adjacent to the front of the housing in an exemplary embodiment. When the frame 44 is in the operative position, support legs 74 extend in corresponding cutouts 72.

As previously mentioned, panels 46 are engaged to the second leg portions of frame members 48 through suitable fasteners 54. Panels 46 of the exemplary embodiment are generally planar and extend generally the full height of the ATM housing 14.

In the exemplary embodiment, panels 46 are configured so as to extend away from the housing and transverse to the user interface surface which is at the front of the machine. Further in the exemplary embodiment, the panels 46 are contoured so as to extend further outward from the housing of the machine in the area adjacent to the input devices of the user interface. This serves to help in blocking visual access by unauthorized persons of inputs and outputs through the user interface.

Each of the panels 46 of the exemplary embodiment includes a horizontally extending shelf 76. The shelves 76 are positioned in supporting connection with the panels through suitable fastening members. The shelf members are vertically disposed below the user interface 18. Shelves 76 serve to provide supporting surfaces for holding items that a user of the machine may not wish to hold while conducting transactions. Further shelves 76 of the exemplary embodiment are configured to provide a convenient writing surface for a user of the machine. It should be understood, however, that the configuration of the panels of the exemplary embodiment are also intended to be ornamental. The present invention is in no way intended to be limited to the particular frame and panel structure shown, and numerous other structures may be devised based on the teachings described herein for providing an apparatus that enhances privacy and/or usability for a user of an automated banking machine.

The exemplary embodiment of the privacy apparatus 42 is installed through a method which includes engaging the privacy apparatus with the exterior surface of the housing 14 of the ATM 12. In an exemplary embodiment the privacy apparatus 42 may be installed by placing the frame members 48 adjacent to the sides 34 of the housing. Thereafter the top brace member 56 may be positioned with the ear portions 60 extending outboard of both frame members 48. Likewise the bottom brace member 64 may be extended below the housing with the ear portions 68 extending upward and outboard of the frame members 48. Thereafter the frame members 48 and brace members 56 and 64 may be fastened together through suitable fasteners and sleeves 60 and 70.

In the exemplary embodiment as shown in FIG. 14, an inward facing surface of frame members 48 includes elongated resilient strips 77. Resilient strips 77 are sized so that when the frame is assembled a biasing force is applied through the frame members to the housing 14. This biasing force through the resilient member 77 serves to engage the frame 44 with the exterior of the housing so as to maintain the frame in engagement therewith so it does not move during operation. Further in some embodiments, resilient strips 77 may include an adhesive on the inward facing surface so as to engage the sides 34 of the housing in more rigid relation. Of course these approaches are exemplary and in other embodiments other approaches may be used.

An advantage of the exemplary construction is that the frame 44 is engaged in supporting connection with the housing without having to drill fastening holes or make other modifications to the existing ATM housing. This eliminates the risk that such fastening holes or other modifications may result in damage to internal components of the machine. In addition, the exemplary approach enables the privacy apparatus 42 to subsequently be removed from the housing without leaving an indication that the apparatus was installed. This may be desirable, for example, if the machine is to be sold as used equipment. Further, this exemplary approach enables the privacy apparatus to be installed on another machine having similar dimensions. Alternatively or in addition, the privacy apparatus may be installed on a machine having different dimensions, such as a machine having a different width dimension by changing the top and bottom brace members to ones having lengths suited to the width of the machine. Of course these approaches are exemplary, and in other embodiments other approaches may be used.

In the exemplary method the panels 46 are attached to the leg portions 52 of the frame members 48 through suitable fasteners or other methods. Shelves 76 are attached in supporting connection with the panels through suitable fasteners or other methods. In an attached position of the panel members 46 each panel extends away from the housing and transverse to the user interface circus. Further, each panel generally extends in a plane that is generally transverse to the plane in which the other panel extends.

This exemplary construction provides for the user in a user position in front of the machine and centered between the panels, to be generally positioned in intermediate relation between the wider areas of the panels. As a result in the exemplary embodiment, a user in this user position has a clear view of the user interface while persons or cameras to the side of and/or behind such a user generally have their view of the user interface blocked by the user and/or enlarged portions of the panels. This serves to enhance privacy for the user.

In alternative methods of installing the privacy apparatus 42, the members which comprise the frame 44 may be assembled together and then the frame moved such that the user interface surface at the front of the machine extends through the opening bounded by the frame. In some embodiments after the frame is inserted around the housing in this manner, the fasteners may be further tightened to more firmly operatively engage the frame to the housing. Of course in other embodiments this approach may be omitted. Alternatively or in addition, the panels 46 may be attached to the frame before the frame is extended around the housing. In some embodiments this may facilitate installation, as the entire privacy assembly may be assembled away from the machine and then quickly installed thereon. Of course these approaches are exemplary and in other embodiments other approaches may be used.

As can be appreciated, in the exemplary embodiment the panels are configured so as to extend furthest away from the housing of the machine in the area of the panels closest to the user interface. Although the panels may extend the full height of the housing, the panels do not extend as far away from the housing in the top and bottom areas of the housing adjacent to the top housing surface and bottom housing surface, respectively. Of course in other embodiments the panels may have different configurations. For example, in automated banking machine that is voice activated it may be desirable to extend the panels further outward from the housing in the upper area. Alternatively or in addition, it may be desirable in some embodiments to provide panels with sound absorbing material to reduce the transmission of the user's voice into the area not bounded by the panels. In an alternative embodiment a horizontally extending panel may also be positioned so as to extend above a user and between the vertically extending panels. Such a horizontally extending panel may further provide privacy and/or sound absorption capability. Of course these approaches are exemplary and in other embodiments other approaches may be used.

In some alternative embodiments, the panels may include additional features and devices. For example in some embodiments the panel may include sound emitters. Such emitters may be in operative connection with the banking machine. Such emitters may provide audible outputs including, for example, instructions for operation of the machine. Alternatively or in addition the sound emitters may operate responsive to a controller in the machine or otherwise to provide masking sounds such as "white noise." Such sound masking may be useful in cases where the machine provides audible outputs or receives audible inputs from the user. In some embodiments masking sounds may be provided continuously, or only during transactions or portions of transactions. Of course these approaches are exemplary.

In other embodiments the panels may be used to support other devices such as signage, lighting or displays. Such devices may be useful in providing promotional information or outputs. They may also be useful in providing instructions to the user on how to operate the machine. Alternatively or in addition, lighting on the panels and directed behind the user may be used to further help to obscure third party viewing of the user's activities at the machine. Alternatively, displays on or in the panels may be used to provide the user with views of the surrounding area in which the terminal is located. The screen outputs may be based on cameras mounted on or in the panels or elsewhere on the machine or in the surrounding area. In addition, the panels may also be used for biometric identification devices including image or sound capture devices that can be used to identify a user and/or to record transaction information. For example, the panels may provide RF or other shielding that can enable the user to use devices that utilize RFID, RF Backscatter, Bluetooth or other RF devices in connection with the machine with reduced risk of interception. This can be done by including conductive materials such as conductive elastomers in the panels, for example.

Thus the features and characteristics of the exemplary embodiments previously described achieve desirable results, eliminate difficulties encountered in the use of prior devices and methods, solve problems, and may attain one or more of the objectives discussed above.

In the foregoing description certain terms have been used for brevity, clarity and understanding. However, no unnecessary limitations are to be implied therefrom, because such terms are for descriptive purposes and are intended to be broadly construed. Moreover, the descriptions and illustrations herein are by way of examples, and the invention is not limited to the details shown and described.

In the following claims any feature described as a means for performing a function shall be construed as encompassing any means capable of performing the recited function and shall not be deemed limited to the particular means shown in the foregoing description or mere equivalents thereof.

Having described the features, discovers and principles of the invention, the manner in which it is constructed and operated, and the advantages and useful results attained; the new and useful structures, devices, elements, arrangements, parts, combinations, systems, equipment, operations, methods, processes and relationships are set forth in the appended claims.

We claim:

1. A method comprising:

(a) placing at least one frame member in supporting connection with at least one exterior surface of a housing of an automated banking machine, wherein the machine includes a cash dispenser and a user interface surface including at least one input device, wherein the machine housing includes a pair of horizontally disposed, generally vertically extending, opposite exterior housing surfaces, wherein in the placing generally vertically extending frame members are respectively placed in operative connection with respective ones of the pair of housing surfaces;

(b) placing at least one panel in supporting connection with the at least one frame member, including placing a panel in supporting connection with a generally vertically extending frame member, wherein the panel extends away from the housing and in a direction transverse to the user interface surface.

2. The method according to claim 1 wherein (b) comprises placing a respective panel in operative connection with each respective one of the frame members, wherein each panel extends away from the housing and in a direction transverse to the user interface surface.

3. The method according to claim 2 wherein a first panel is in supporting connection with a first one of the vertically extending frame members and extends vertically in a first vertical plane, and wherein a second panel is operatively connected to a second one of the vertically extending frame members and extends vertically in a second vertical plane generally transverse to the first vertical plane.

4. The method according to claim 1 wherein the housing includes a generally horizontally extending top housing surface, and further comprising:

(c) placing a top frame member above the top surface and in supporting connection with both of the vertically extending frame members.

5. The method according to claim 4 wherein the top frame member includes a central portion and two opposed ear portions extending generally perpendicular to the central portion, and wherein in (c) each one of the ear portions extend in operative engagement with one of the vertically extending frame members.

6. The method according to claim 5 wherein in (c) each of the ear portions extend generally downward, and wherein each of both vertically extending frame members extends in intermediate relation between a vertically extending housing surface and an ear portion.

7. The method according to claim 4 wherein the machine includes a generally horizontally extending bottom housing surface, and further comprising:

(d) placing a bottom brace member below the bottom housing surface and in supporting connection with each of both vertically extending frame members.

8. The method according to claim 7 wherein the bottom brace member includes a central portion and two opposed ear portions extending generally perpendicular to the central portion, and wherein in (d) each one of the ear portions is placed in operative engagement with one of the vertically extending frame members.

9. The method according to claim 8 wherein in (d) each of the ear portions extend generally upward, and wherein each of both vertically extending frame members extends in intermediate relation between a vertically extending housing surface and an ear portion.

10. The method according to claim 9 wherein the machine includes a at least one support leg extending below the bottom housing surface, and wherein the central portion includes at least one cutout, and wherein (d) includes positioning at least one support leg of the machine respectively within at least one cutout of the central portion.

11. The method according to claim 1 wherein the machine housing has a height, and wherein in (b) the at least one panel extends substantially the height of the housing.

12. A method comprising:

(a) placing at least one frame member in supporting connection with at least one exterior housing surface of an automated banking machine, wherein the machine includes a cash dispenser and a user interface surface including at least one input device, wherein each frame member comprises in cross section a pair of operatively connected leg portions, wherein in the placing a first leg portion is placed in supporting connection with the at least one exterior housing surface;

(b) placing at least one panel in supporting connection with the at least one frame member, wherein the at least one panel extends away from the housing and in a direction transverse to the user interface surface, and wherein a second leg portion is placed in supporting connection with the at least one panel.

13. The method according to claim 12 wherein in cross section the second leg portion extends at an obtuse angle relative to the first leg portion, and wherein in (b) the at least one panel extends at an obtuse angle relative to the user interface surface.

14. A method comprising:

(a) placing at least one frame member in supporting connection with at least one exterior housing surface of an automated banking machine, wherein the machine includes a cash dispenser and a user interface surface including at least one input device;

(b) placing at least one panel in supporting connection with the at least one frame member, wherein the at least one panel extends away from the housing and in a direction transverse to the user interface surface, wherein in the placing a pair of horizontally disposed panels are placed in operative connection with the at least one frame member;

(c) placing at least one generally horizontally extending shelf in supporting connection with the at least one panel, including placing a first generally horizontally extending shelf in supporting connection with a first panel and a second generally horizontally extending shelf in supporting connection with a second panel.

15. A method comprising:

(a) placing a frame in operative connection with an exterior housing of an existing automated banking machine, wherein the machine includes a cash dispenser and a user interface including at least one input device, wherein the machine is adapted to be operated through the user interface by a user in a user position, wherein the housing has a height, wherein the housing has a top area and a bottom area;

(b) placing at least one generally vertically extending panel in supporting connection with the frame, wherein the at least one panel extends outward from the housing, extends horizontally transverse of the user position, and extends generally the height of the housing, and wherein the at least one panel extends further outward from the housing in an area horizontally disposed of the user interface than in the top area and in the bottom area.

16. The method according to claim 15 wherein (b) comprises placing two panels in supporting connection with the frame, wherein a first panel extends on a first transverse side of the user position and a second panel extends on a second transverse side of the user position.

17. The method according to claim 15 wherein in (b) the at least one panel includes in supporting connection therewith a generally horizontally extending shelf positioned below the at least one input device.

18. The method according to claim 15 wherein in (a) the frame includes a pair of horizontally disposed vertically extending frame members, and wherein (b) comprises placing at least one panel in supporting connection with one of the frame members.

19. The method according to claim 18 wherein in (a) the frame includes a pair of vertically disposed brace members in supporting connection with the frame members.

20. The method according to claim 19 wherein the exterior housing includes a top housing surface and a bottom housing surface, and wherein (a) includes extending one of the pair of brace members above the top housing surface and another of the pair of brace members below the bottom housing surface.

21. Apparatus comprising:

an automated banking machine including a cash dispenser and a user interface surface including at least one input device, wherein the automated banking machine includes an exterior housing;

a frame in supporting connection with the exterior housing, wherein the frame includes a pair of opposed generally vertically extending frame members, wherein the frame includes a pair of horizontally extending brace members extending externally of the exterior housing;

at least one vertically extending panel in supporting connection with the frame, wherein the at least one vertically extending panel extends away from the exterior housing and transverse to the user interface surface.

22. The apparatus according to claim 21 wherein each frame member comprises in cross section a first leg portion and a second leg portion, wherein the second leg portion extends in cross section at an obtuse angle relative to the first leg portion, and wherein the at least one panel is in operative engagement with the second leg portion.

23. The apparatus according to claim 21 wherein the frame includes a top brace member extending above the housing, and wherein the frame includes a bottom brace member extending below the housing.

24. The apparatus according to claim 23 wherein each of the top and bottom brace members include vertically extending ear portions, and wherein a frame member extends in intermediate relation between the housing and the ear portions of both the top brace member and the bottom brace member.

25. The apparatus according to claim 23 wherein the machine includes at least one support leg extending below the housing, wherein the bottom brace member includes at least one cutout, and wherein at least one support leg of the machine respectively extends in at least one cutout of the bottom brace member.

26. The apparatus according to claim 21 wherein two vertically extending panels are engaged in supporting connection with the frame, wherein the two vertically extending panels are horizontally disposed from each other and are located on opposed sides of the housing.

27. The apparatus according to claim 26 wherein each of the panels includes a generally horizontally extending shelf.

28. Apparatus comprising:

an automated banking machine including a cash dispenser and a user interface surface including at least one input device, wherein the automated banking machine includes an exterior housing, wherein the housing has a height, a top area, and a bottom area, and wherein the at least one input device is vertically intermediate of the top area and the bottom area;

a frame in supporting connection with the exterior housing;

at least one vertically extending panel in supporting connection with the frame, wherein the at least one vertically extending panel extends away from the housing and transverse to the user interface surface, wherein the at least one vertically extending panel extends generally the height of the housing, and wherein the at least one vertically extending panel extends further outward from the housing horizontally adjacent the at least one input device than horizontally adjacent the top and bottom areas.

* * * * *